US010589946B2

(12) United States Patent
Maehara et al.

(10) Patent No.: US 10,589,946 B2
(45) Date of Patent: Mar. 17, 2020

(54) STACKING APPARATUS AND FEEDING APPARATUS

(71) Applicant: CANON FINETECH NISCA INC., Misato-shi (JP)

(72) Inventors: Kazuya Maehara, Saitama-ken (JP); Saori Yokote, Chiba-ken (JP)

(73) Assignee: Canon Finetech Nisca Inc., Misato-shi (JP)

( * ) Notice: Subject to any disclaimer, the term of this patent is extended or adjusted under 35 U.S.C. 154(b) by 0 days.

(21) Appl. No.: 15/998,533

(22) Filed: Aug. 16, 2018

(65) Prior Publication Data

US 2019/0062090 A1 Feb. 28, 2019

(30) Foreign Application Priority Data

Aug. 31, 2017 (JP) ..... 2017-167642

(51) Int. Cl.

| | |
|---|---|
| ***B65H 1/04*** | (2006.01) |
| ***B65H 31/24*** | (2006.01) |
| ***B65H 1/14*** | (2006.01) |
| ***B65H 9/10*** | (2006.01) |

(52) U.S. Cl.

CPC ..... *B65H 1/04* (2013.01); *B65H 1/14* (2013.01); *B65H 9/101* (2013.01); *B65H 31/24* (2013.01); *B65H 2405/15* (2013.01); *B65H 2407/50* (2013.01); *B65H 2511/11* (2013.01); *B65H 2511/12* (2013.01); *B65H 2511/22* (2013.01); *B65H 2801/06* (2013.01)

(58) Field of Classification Search

CPC . B65H 1/04; B65H 9/101; B65H 9/04; B65H 31/20; B65H 2405/15; B65H 2511/12

USPC ..... 271/171

See application file for complete search history.

(56) References Cited

U.S. PATENT DOCUMENTS

| | | | | |
|---|---|---|---|---|
| 7,918,448 | B2 | 4/2011 | Suzuki et al. | |
| 9,079,727 | B2 | 7/2015 | Nakagawa | |
| 2006/0267270 | A1 | 11/2006 | Suzuki et al. | |
| 2015/0284196 | A1 | 10/2015 | Mitsui et al. | |
| 2018/0354738 | A1* | 12/2018 | Yazawa ..... | B65H 1/04 |

FOREIGN PATENT DOCUMENTS

| | | | |
|---|---|---|---|
| JP | 07-157097 | A | 6/1995 |
| JP | 2002-255359 | A | 9/2002 |
| JP | 2002-347956 | A | 12/2002 |

(Continued)

OTHER PUBLICATIONS

Extended European Search Report dated Dec. 3, 2018, in European Patent Application No. 18188176.4.

(Continued)

*Primary Examiner* — David H Bollinger
(74) *Attorney, Agent, or Firm* — Venable LLP

(57) ABSTRACT

In a sheet stacking apparatus, a first notch portion in which a first limiting member is movable and a second notch portion in which a second limiting member is movable are formed in a stacking surface of a stacking unit, and the first and second notch portions are arranged such that a minimum distance between the first notch portion and a center of the stacking unit in the widthwise direction is shorter than a minimum distance between the second notch portion and the center of the stacking unit in the widthwise direction.

10 Claims, 9 Drawing Sheets

(56) References Cited

FOREIGN PATENT DOCUMENTS

| | | | |
|---|---|---|---|
| JP | 2006-327805 | A | 12/2006 |
| JP | 2007-145434 | A | 6/2007 |
| JP | 2015-020877 | A | 2/2015 |
| JP | 2016-128344 | A | 7/2016 |

OTHER PUBLICATIONS

Office Action dated Dec. 20, 2019, in Japanese Patent Application No. 2017-167642.

* cited by examiner

STACKING APPARATUS AND FEEDING APPARATUS

BACKGROUND OF THE INVENTION

Field of the Invention

The present invention relates to a stacking apparatus and a feeding apparatus capable of feeding sheets of a plurality of sizes.

Description of the Related Art

Some image forming apparatuses such as a copying machine and printer have an arrangement which includes a sheet storage unit and a feeding unit such as a feeding roller for feeding sheets stored in the sheet storage unit, and feeds a sheet stored in the sheet storage unit to an image forming unit by the feeding unit. In general, in order to feed the sheet of the sheet storage unit stably, side limiting members for limiting the edges of a sheet in a widthwise direction are formed In a feeding apparatus of Japanese Patent Laid-Open No. 2016-128344, a plurality of side limiting members are arranged to be able to correspond to various sheet sizes. At this time, positions when the side limiting members are opened at a maximum and when they are opened at a minimum are made equal between a plurality of side limiting plates.

On the other hand, in the recent printing market, needs for performing printing on elongated paper sheets longer than regular-size paper sheets such as A3 and A4 are increasing. Elongated paper sheets are used for a book cover, facing pages of a catalogue, POP advertisement, and the like.

A feeding apparatus corresponding to elongated paper sheets is configured to limit plain paper sheets such as A3 and A4 in the widthwise direction by the first side limiting member, and limit elongated paper sheets in the widthwise direction by the first and second side limiting members. A stacking tray for stacking sheets is also provided. The stacking tray includes notch portions to which the side limiting members are to be fitted so that the side limiting members can move in accordance with the width of a sheet.

Note that in the feeding apparatus corresponding to elongated paper sheets, a minimum width capable of widthwise alignment by the first side limiting member needs to correspond to, for example, up to a small sheet of a postcard size or the like. On the other hand, the second side limiting member should limit only elongated paper sheets, and thus only needs to correspond to, for example, up to an A4-width size.

However, if the minimum width capable of widthwise alignment by the plurality of side limiting members is arranged in the same manner, an opening by the notch portion to which the second side limiting member is to move may open more than necessary. Note that the feeding apparatus corresponding to elongated paper sheets uses plain paper sheets frequently. Accordingly, while the opening of the first limiting member is often covered with a sheet, the opening of the second limiting member is often open. Therefore, a user may damage the apparatus by dropping a foreign substance from the openings when, for example, replenishing sheets.

SUMMARY OF THE INVENTION

The present invention provides a stacking apparatus and a feeding apparatus that minimize an opening portion generated by moving a limiting member.

The present invention in one aspect provides a stacking apparatus capable of stacking a first sheet as a sheet fed to a predetermined apparatus and a second sheet having a larger size than the first sheet in a feeding direction in which the sheet is fed to the predetermined apparatus, the stacking apparatus comprising: a stacking unit configured to stack the first sheet and the second sheet; a first limiting unit movable in a widthwise direction perpendicular to the feeding direction, and configured to limit edges of the first sheet and the second sheet in the widthwise direction; and a second limiting unit movable in the widthwise direction, configured to limit the edges of the second sheet in the widthwise direction, and provided on an upstream side of the first limiting unit in the feeding direction, wherein a first notch portion to which the first limiting unit is movable and a second notch portion to which the second limiting unit is movable are formed in a stacking surface of the stacking unit, and the first notch portion and the second notch portion are arranged such that a minimum distance between the first notch portion and a center of the stacking unit in the widthwise direction is smaller than a minimum distance between the second notch portion and the center of the stacking unit in the widthwise direction.

The present invention can minimize the opening portion generated by moving the limiting member.

Further features of the present invention will become apparent from the following description of exemplary embodiments with reference to the attached drawings.

DESCRIPTION OF THE EMBODIMENTS

Figure 1:
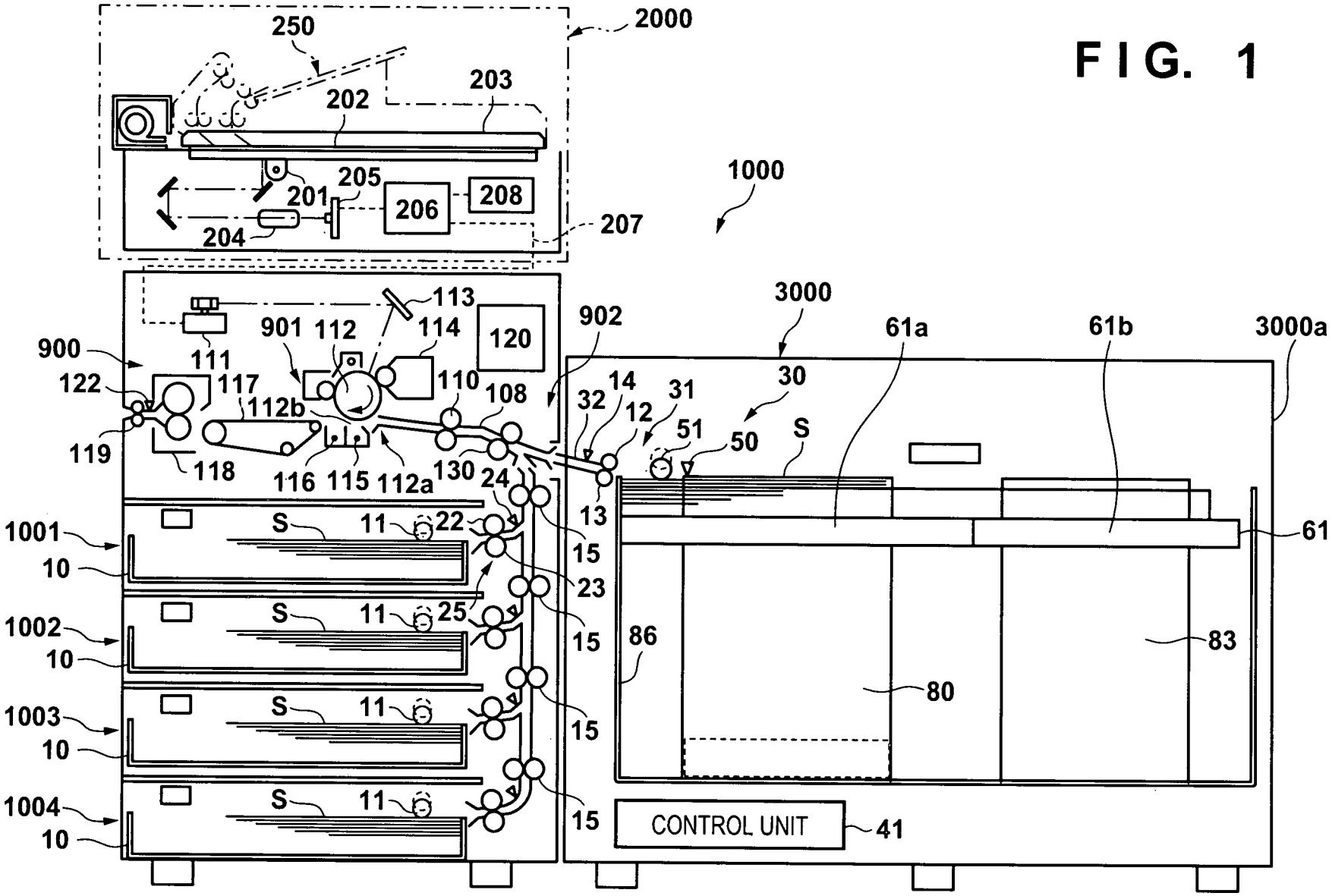
FIG. 1 is a schematic sectional view showing an image forming apparatus including a sheet feeding apparatus.

Preferred embodiments of the present invention will now be described hereinafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention. Note that the same reference numerals denote the same constituent elements, and an explanation thereof will be omitted.

FIG. 1 is a schematic sectional view showing an image forming apparatus including a sheet feeding apparatus according to an embodiment of the present invention. An image forming system 1000 includes an image forming apparatus 900, a scanner apparatus 2000 arranged on the upper surface of the image forming apparatus 900, and a paper deck 3000 connected to the image forming apparatus 900.

The scanner apparatus 2000 for reading a document includes a scanning optical system light source 201, a platen glass 202, an openable/closable document press plate 203, a lens 204, a light-receiving element (photoelectric conversion element) 205, an image processor 206, a memory unit 208, and the like. The memory unit 208 stores an image processing signal processed by the image processor 206.

When reading a document, the scanner apparatus 2000 reads a document (not shown) placed on the platen glass 202 by irradiating the document with light from the scanning optical system light source 201. The read document image is processed by the image processor 206, converted into an electrical signal 207 which is electrically encoded, and transmitted to a laser scanner 111 in the image forming apparatus 900.

Note that it is also possible to temporarily store the image information processed by the image processor 206 and encoded in the memory unit 208, and transmit the stored information to the laser scanner 111 as needed in accordance with a signal from a controller 120 (to be described later). Note also that the paper deck 3000 includes a control unit 41 which controls the paper deck 3000 in accordance with a command from the controller 120, and includes a CPU, a RAM, and a ROM.

The image forming apparatus 900 includes first to fourth sheet feeding apparatuses 1001 to 1004 for feeding sheets S, and a sheet conveying apparatus 902 for conveying the sheets S fed from the sheet feeding apparatuses 1001 to 1004 to an image forming unit 901. The image forming apparatus 900 includes the controller 120 which controls the individual units of the image forming system 1000, and includes a CPU, a RAM, and a ROM.

Each of the first to fourth sheet feeding apparatuses 1001 to 1004 includes a feeding cassette 10 for storing the sheets S, a pickup roller 11, and a separation conveyor roller pair 25 including a feed roller 22 and a retard roller 23. The sheets S stored in the feeding cassette 10 are separately fed one by one by the pickup roller 11 which performs a vertical moving operation and rotates at a predetermined timing, and the separation conveyor roller pair 25.

In addition, a feed sensor 24 is arranged near the downstream side of the feed roller 22 and retard roller 23 in the sheet feeding direction. The feed sensor 24 senses the passing of the sheet S, and transmits a sensing signal to the controller 120.

The sheet conveying apparatus 902 includes a conveyor roller pair 15, a pre-registration roller pair 130, and a registration roller pair 110. The sheet S fed from the sheet feeding apparatuses 1001 to 1004 is passed through a sheet conveyance path 108 by the conveyor roller pair 15 and the pre-registration roller pair 130, and guided to the registration roller pair 110. After that, the registration roller pair 110 supplies the sheet S to the image forming unit 901 at a predetermined timing.

The image forming unit 901 includes a photosensitive drum 112, the laser scanner 111, a developing device 114, a transfer charging device 115, a separation charging device 116, and the like. In image formation, a mirror 113 reflects a laser beam from the laser scanner 111, and the photosensitive drum 112 rotating clockwise is irradiated with the laser beam, thereby forming an electrostatic latent image on the photosensitive drum. Then, the electrostatic latent image formed on the photosensitive drum is developed as a toner image by the developing device 114.

This toner image on the photosensitive drum is transferred onto the sheet S by the transfer charging device 115 in a transfer unit 112*b*. Furthermore, the sheet S onto which the toner image is thus transferred is electrostatically separated from the photosensitive drum 112 by the separation charging device 116, conveyed by a conveyor belt 117 to a fixing apparatus 118 where the toner image is fixed, and then discharged by discharge rollers 119. The image forming unit 901 and the fixing apparatus 118 form an image on the sheet S fed from a sheet feeding apparatus 30 (or the sheet feeding apparatuses 1001 to 1004).

In addition, a discharge sensor 122 is arranged in a conveyance path between the fixing apparatus 118 and the discharger rollers 119. The controller 120 detects the passing of the discharged sheet S based on a sensing signal from this discharge sensor 122.

Note that the image forming apparatus 900 and the scanner apparatus 2000 are formed as discrete units in this embodiment, but the image forming apparatus 900 and the scanner apparatus 2000 may also be integrated. Note also that regardless of whether the image forming apparatus 900 and the scanner apparatus 2000 are separated or integrated, the apparatus functions as a copying machine when a processing signal of the scanner apparatus 2000 is input to the laser scanner 111, and functions as a FAX apparatus when a FAX transmission signal is input to the laser scanner 111. Furthermore, the apparatus also functions as a printer when a signal from a personal computer (PC) is input.

Conversely, when a processing signal of the image processor 206 of the scanner apparatus 2000 is transmitted to another FAX apparatus, the apparatus functions as a FAX apparatus. In addition, if an automatic document feeder (ADF) 250 as indicated by the alternate long and two short dashed lines is used instead of the press plate 203 in the scanner apparatus 2000, documents (not shown) can be fed and read in succession.

Figure 2:
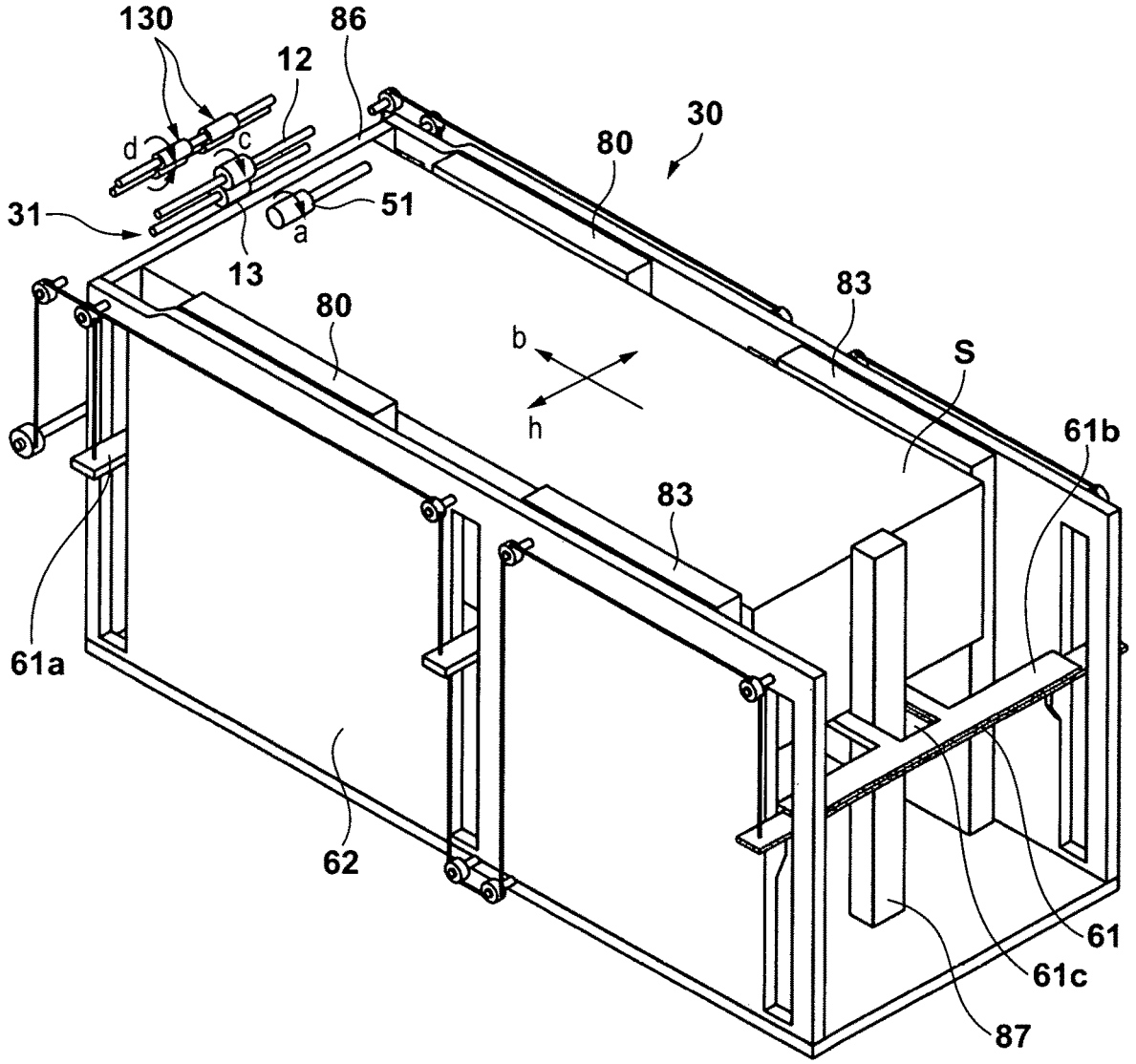
FIG. 2 is a perspective view showing main parts of a paper deck.
Figure 3:
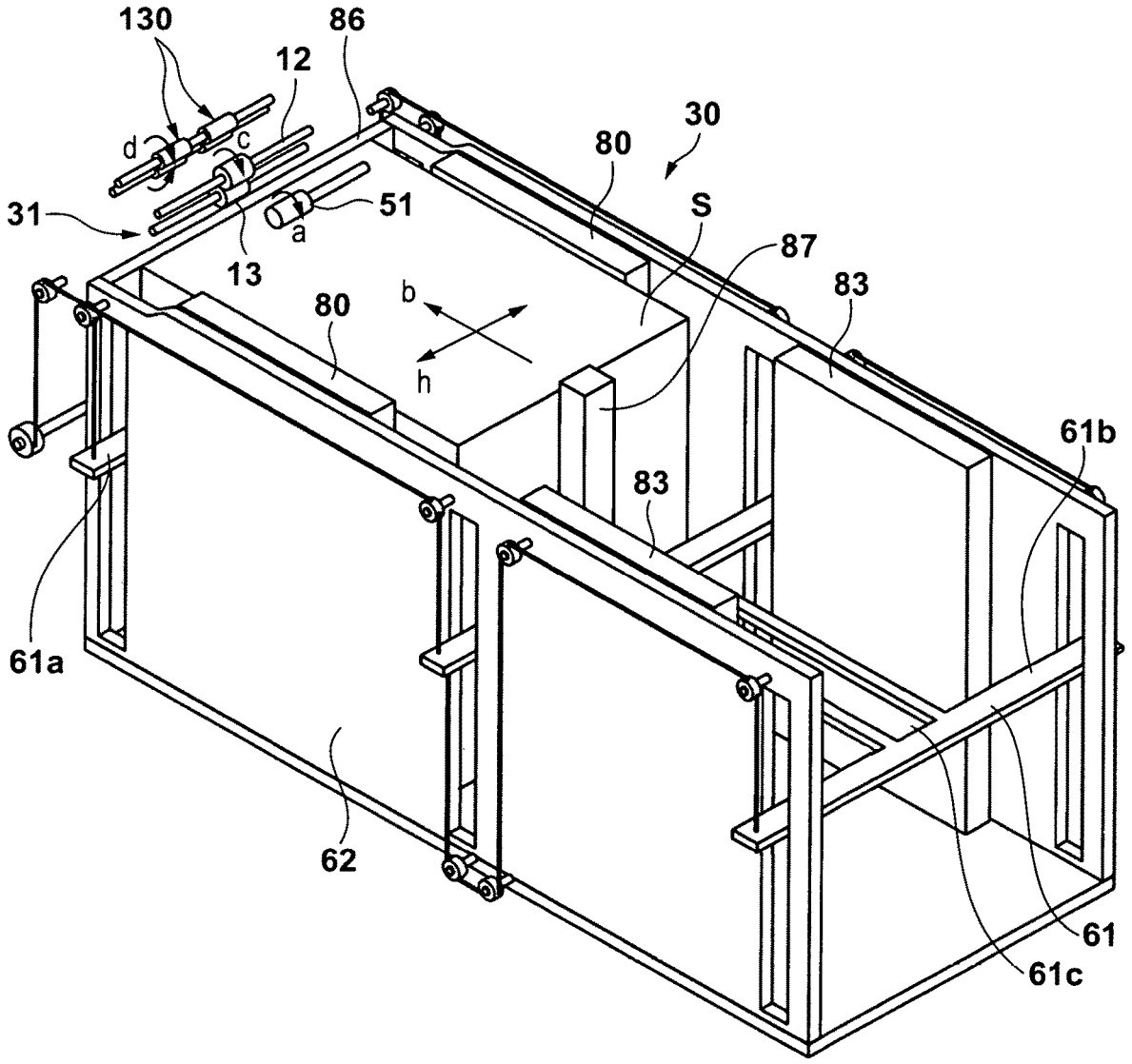
FIG. 3 is a perspective view showing the main parts of the paper deck.

Next, the sheet feeding apparatus 30 of the image forming system 1000 according to this embodiment will be explained by taking the paper deck 3000 as a large-capacity deck as an example. FIGS. 2 and 3 are perspective views each showing main parts of the paper deck 3000 with an exterior cover being removed. FIG. 2 shows a state in which elongated paper sheets are inserted. FIG. 3 shows a state in which plain paper sheets are inserted.

As shown in FIGS. 1, 2, and 3, the paper deck 3000 includes a main body 3000*a*, a large-capacity deck storage 62 accommodated in the main body 3000*a*, and the sheet feeding apparatus 30. This sheet feeding apparatus 30 feeds the sheets S stacked and accommodated in the large-capacity deck storage 62 to the image forming unit 901.

The sheet feeding apparatus 30 includes a pickup roller 51 for feeding the sheets S stacked in a main lifter 61*a* (first stacking unit) on which sheets SS of regular-size paper (to be referred to as plain paper hereinafter) are stacked and an extension lifter 61*b* (second stacking unit) which is used to feed sheets SL of large-size paper (elongated paper) (to be referred to as a lifter 61 altogether hereinafter), and a separation conveyor roller pair 31 which is formed by a feed roller 12 and a retard roller 13. The sheet feeding apparatus 30 can include a stacking apparatus, except for a sheet feeding mechanism, comprising a first stacking unit and a second stacking unit. The extension lifter 61*b* is used to extend a stacking area of the main lifter 61*a* in a conveyance direction. The pickup roller 51 is arranged near the distal end portion in the sheet feeding direction (the direction of an arrow b) so that the pickup roller 51 can be urged against the uppermost sheet on the lifter 61 by applying an appropriate force to the sheet. The pickup roller 51 is positioned above the lifter 61 and abuts against the uppermost one of the sheets S stacked on the lifter 61 having moved upward, thereby feeding the uppermost sheet.

Sheets can be stacked on the lifter 61. The lifter 61 is supported by a driving mechanism 54 (FIG. 6) including a vertical movement motor 55 so as to be movable upward and downward. In addition, a sheet surface sensor 50 is arranged on the upstream side of the pickup roller 51 above the lifter 61. The sheet surface sensor 50 is positioned above the lifter 61, and senses the sheets S on the stacking member.

The sheet feeding apparatus 30 includes the lifter 61, and two pairs of side limiting members 80 and 83. The side limiting members 80 and 83 can limit the side edge positions of the sheets S stacked on the lifter 61 in the widthwise direction (the direction of an arrow h in FIGS. 2 and 3) perpendicular to the feeding direction (the direction of the arrow b in FIGS. 2 and 3), and both of the side limiting members 80 and 83 can move in the widthwise direction.

In this embodiment, the pickup roller 51 can be urged against the uppermost one of the sheets S on the stacking member by applying an appropriate force to the uppermost sheet. The sheets S on the lifter 61 are separately fed one by one by the pickup roller 51 which vertically moves and rotates at a predetermined timing and the separation conveyor roller pair 31.

A connecting conveyance path 32 for feeding the sheet S from the paper deck 3000 to the pre-registration roller pair 130 of the image forming apparatus 900 is arranged in that portion of the paper deck 3000, which is connected to the image forming apparatus 900.

In the large-capacity deck storage 62, the two pairs of side limiting members 80 and 83 are arranged on the two sides in the direction (the widthwise direction in this embodiment) perpendicular to the sheet feeding direction (the direction of the arrow b). The two pairs of side limiting members 80 and 83 can slide to the widths of all sheet sizes corresponding to the specifications, and can guide the sheets S on the lifter 61. That is, the side limiting members 80 and 83 are so supported as to be movable in the widthwise direction, and limit the two side positions of the stacked sheets S by abutting against the two side edges of the sheets S. Note that a leading edge limiting member 86 in FIG. 1 limits the leading edges of the sheets S on the lifter 61.

Also, a trailing edge limiting member 87 is so arranged as to limit the trailing edges of the sheets S on the lifter 61. The trailing edge limiting member 87 is so supported as to be movable parallel to in the sheet feeding direction (the direction of the arrow b), and limits the trailing edge positions of the sheets S. The trailing edge limiting member 87 can move along a positioning elongated hole 61*c* (FIGS. 2 and 3) formed in the central portion of the lifter 61.

As shown in FIGS. 2 and 3, when the pickup roller 51 is driven by a driving unit (not shown) to rotate in the direction of feeding the sheets S (the direction of an arrow a), the uppermost sheet S is fed in the direction of the arrow b. Consequently, the sheet S abuts against the nip portion of the separation conveyor roller pair 31 adjacent to the exit side of the pickup roller 51.

If multi feed occurs on the sheets S fed by the pickup roller 51, the following operation is performed. That is, the retard roller 13, which rotates in the direction opposite to that of the feed roller 12, which rotates in the same direction (the direction of an arrow c) as the arrow a, rotates in the same direction as that of the feed roller 12 if two or more sheets S abut against the nip portion. Then, the retard roller 13 pushes the second and subsequent sheets S in the nip portion back in the direction of the lifter 61, and the feed roller 12 feeds only a single uppermost sheet S in the direction of the arrow b.

When the sheet S is fed from the paper deck 3000 having the above arrangement or from one of the first to fourth sheet feeding apparatuses 1001 to 1004, the leading edge of the sheet S abuts against the nip portion of the pre-registration roller pair 130. The pre-registration roller pair 130 includes a pair of opposite rollers, and is arranged on the conveyance path of the sheets S so as to be rotatable in the direction of an arrow d in FIGS. 2 and 3 by a driving unit (not shown). The sheet S, which once abuts against the nip portion of the pre-registration roller pair 130, is conveyed into the image forming apparatus 900 by the roller pair 130, which rotates in synchronism with the feed timing.

Figure 7A:
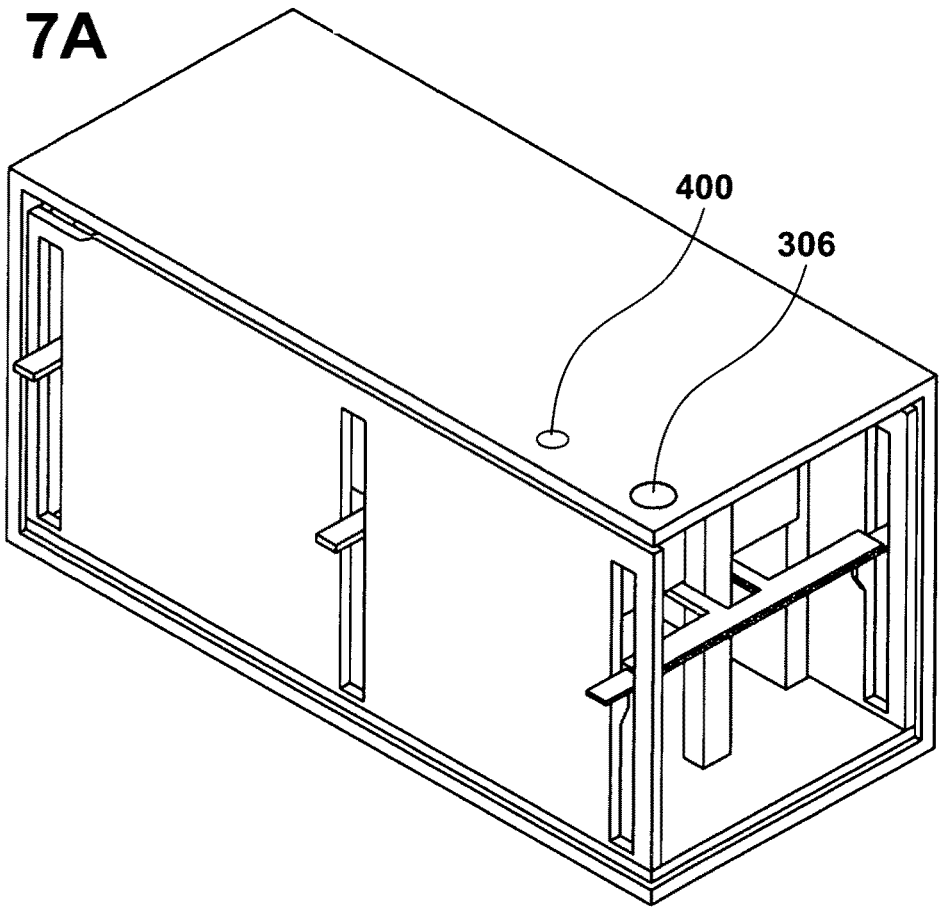
FIGS. 7A and 7B are views each showing a retracted state of a large-capacity deck storage.
Figure 7B:
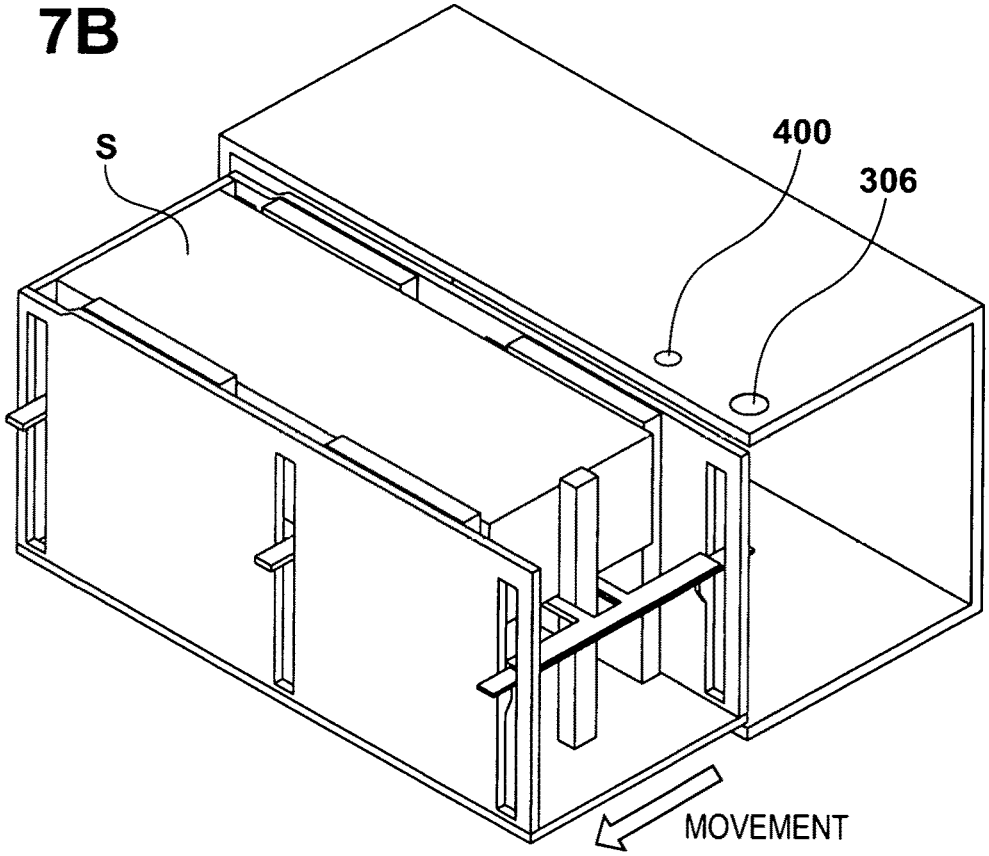

FIG. 7A is a view showing a state in which the large-capacity deck storage 62 is retracted in the paper deck 3000. A storage opening/closing button 306 is a button for accepting an instruction to pull out the large-capacity deck storage 62. The large-capacity deck storage 62 can be pulled out when the user presses the storage opening/closing button 306. FIG. 7B is a view showing a state in which the large-capacity deck storage 62 is pulled out to the front side from the paper deck 3000. The large-capacity deck storage 62 is pulled out as shown in FIG. 7B when, for example, the user replenishes sheets, removes sheets remaining in the lifter 61, or performs mode switching (to be described later). As will be described later, the paper deck 3000 includes an LED 400 for notifying the user of the states of the main lifter 61*a* and extension lifter 61*b*.

The lifter 61 includes the main lifter 61*a* and the extension lifter 61*b*. As shown in FIG. 2, a plurality of wires are connected to the wire fulcrums of the main lifter 61*a*, and the main lifter 61*a* is suspended by these wires. When the wires are wound by a winding unit connected to a motor, the main lifter 61*a* moves upward. When the wires are fed, the main lifter 61*a* moves downward.

The extension lifter 61*b* is installed as it is supported by an extension lifter support member (not shown) and the large-capacity deck storage 62. The extension lifter 61*b* itself has no driving power and performs the vertical moving operation by being coupled with and in cooperation with the main lifter 61*a*.

Figure 6:
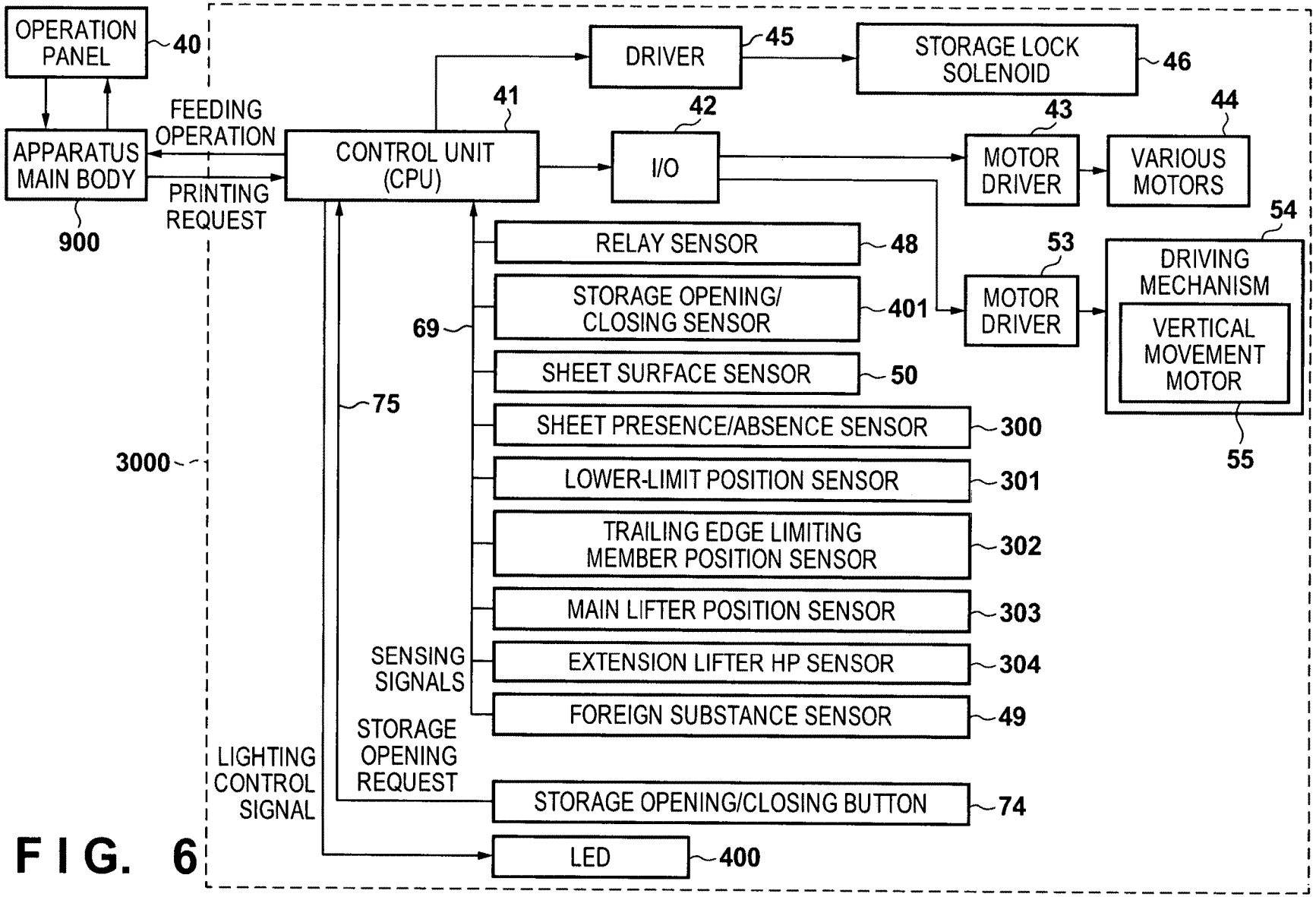
FIG. 6 is a block diagram showing the arrangement of a control system of the paper deck.

FIG. 6 is a view showing the block configuration of the image forming system 1000 for implementing the operation of this embodiment. FIG. 6 shows the paper deck 3000, the image forming apparatus 900, and an operation panel 40. The, operation panel 40 displays various user interface screens such as apparatus information, a setting screen, and job information, and accepts instructions and setting operations from the user. The operation panel 40 is formed on, for example, the image forming apparatus 900. The image forming apparatus 900 issues a printing request to the control unit 41 of the paper deck 3000. When receiving this printing request from the image forming apparatus 900, the control unit 41 performs a feeding operation for the image forming apparatus 900. Alternatively, the image forming apparatus 900 may include the control unit 41.

The control unit 41 comprehensively controls the paper deck 3000. For example, when receiving an opening/closing request signal input by the user by pressing the storage opening/closing button 306, the control unit 41 cancels the locked state of a storage lock solenoid 46 via a driver 45, thereby opening the large-capacity deck storage 62. The control unit 41 drives various motors 44 on the sheet conveyance path via a motor driver 43 connected to an input/output interface (I/O) 42. Also, the control unit 41 controls the driving mechanism 54 for vertically moving the main lifter 61*a* and the extension lifter 61*b* via a motor driver 53 connected to the input/output interface (I/O) 42. The driving mechanism 54 includes the vertical movement motor 55. The vertical movement motor 55 drives the winding unit (not shown).

A relay sensor 48, a main lifter position sensor 303, and an extension lifter HP sensor 304 are provided at predetermined positions in a vertical direction (vertical movement direction) of the main lifter 61*a* and extension lifter 61*b*. The relay sensor (lifter standby position sensor) 48 is used to, for example, sense that the main lifter 61*a* is at a standby position. The main lifter position sensor 303 and the extension lifter HP sensor 304 are used to, for example, sense that the main lifter 61*a* and the extension lifter 61*b* are coupled to each other at a predetermined position in the vertical movement direction.

The sheet surface sensor 50 and a sheet presence/absence sensor 300 are located above the lifter 61 and sense the sheet S on the stacking member. A lower-limit position sensor 301 is used to sense that the main lifter 61*a* is at a lower-limit position. A trailing edge limiting member position sensor 302 is used to sense each position of the trailing edge limiting member 87 as shown in FIGS. 2 and 3. A foreign substance sensor 49 is used to sense a foreign substance on the stacking unit of the extension lifter 61*b*.

Sensing signals from the relay sensor 48, a storage opening/closing sensor 401, the sheet surface sensor 50, and the sheet presence/absence sensor 300 are transmitted to the control unit 41. The storage opening/closing sensor 401 is a sensor for sensing the opening/closing state of the storage. Sensing signals from the lower-limit position sensor 301, the trailing edge limiting member position sensor 302, the main lifter position sensor 303, the extension lifter HP sensor 304, and the foreign substance sensor 49 are transmitted to the control unit 41. In addition, a storage opening request signal generated by the user by pressing the storage opening/closing button 306 is transmitted to the control unit 41.

The control unit 41 controls lighting of the LED 400 by a lighting control signal. For example, in accordance with a plain paper mode/elongated paper mode, the control unit 41 controls lighting of the LED 400 based on a predetermined pattern.

[Arrangement of Side Limiting Member]

Figure 4:
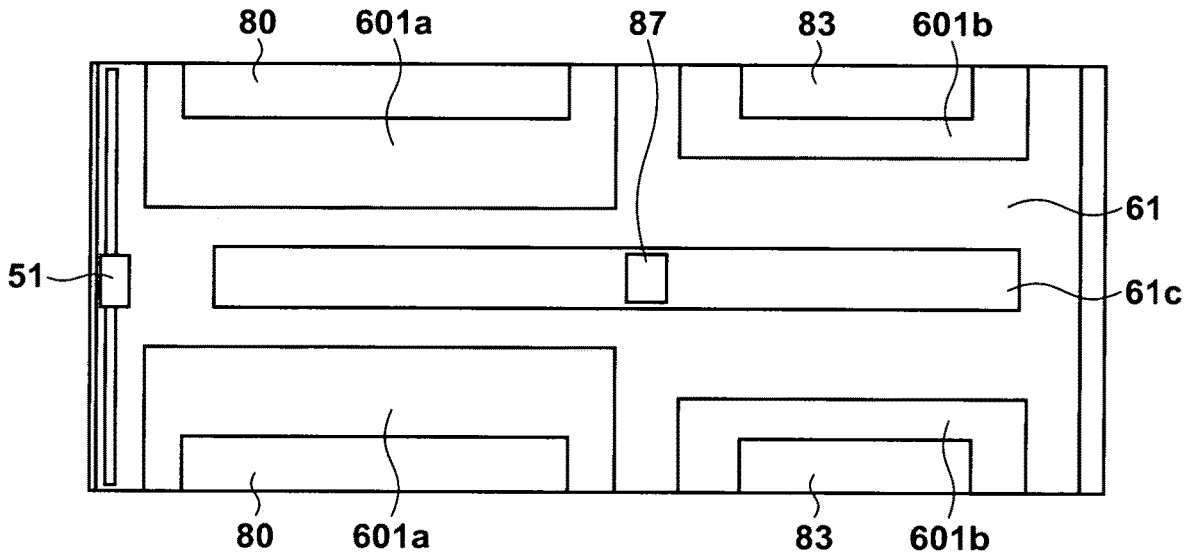
FIG. 4 is a plan view showing the interior of a storage.

The arrangements of the side limiting members 80 and 83 will be described next with reference to FIG. 4. The pair of side limiting members 80 are arranged downstream in the sheet conveyance b direction shown in FIGS. 2 and 3 with respect to the pair of side limiting members 83. As described above, the side limiting members 80 need to slide to the widths of all sheet sizes compatible with the specifications in the sheet feeding apparatus 30. On the other hand, the side limiting members 83 need to slide to the widths of all sheet sizes corresponding to elongated paper sheets. For example, while the minimum width on the specifications is about 148 mm (postcard size), the minimum width of an elongated paper sheet is about 210 mm (A4 size). The side limiting members 80 and 83 correspond to the respective widths.

Figure 5A:
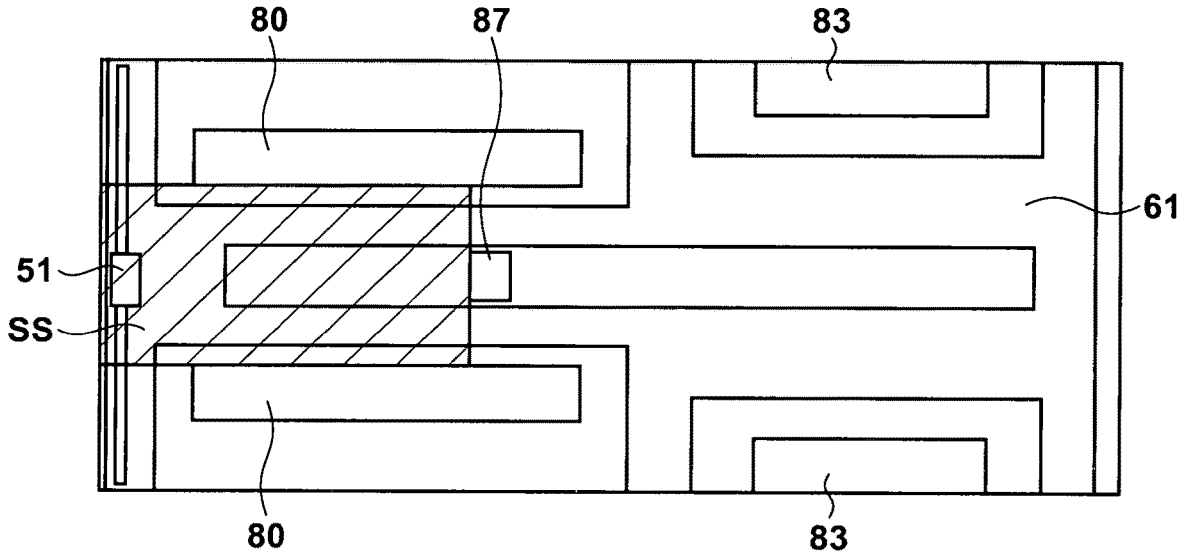
FIGS. 5A and 5B are plan views each showing the interior of the storage.
Figure 5B:
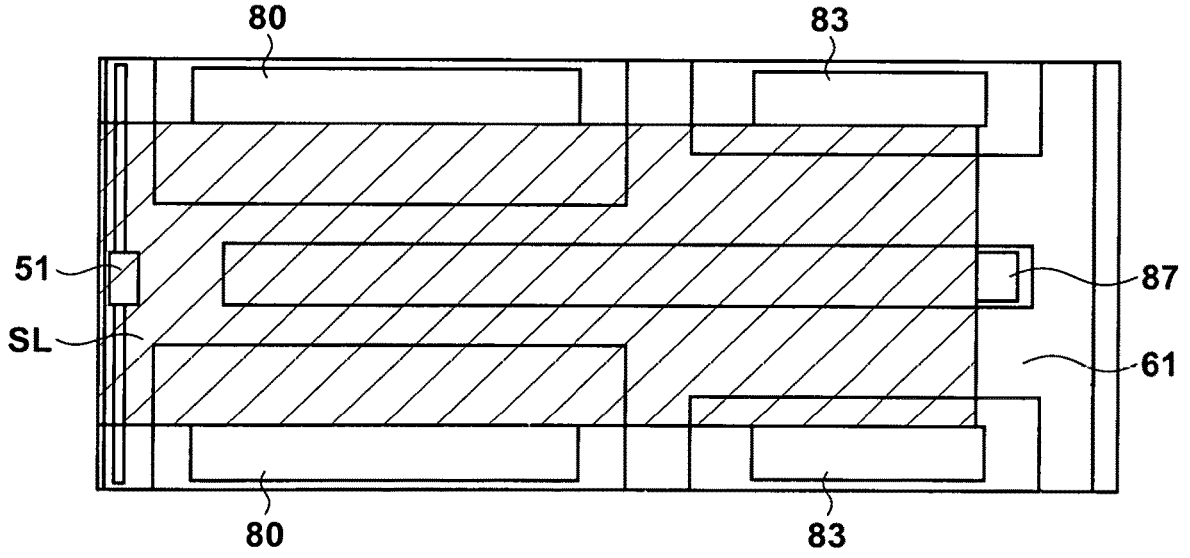

Openings 601*a* and 601*b* are provided on the lifter 61 to be movable by the side limiting members 80 and the side limiting members 83. The openings 601*a* and 601*b* are notch portions formed in the lifter 61 to be movable by the side limiting members 80 and 83. The openings 601*a* corresponding to the side limiting members 80 are formed to be larger than the openings 601*b* in order to correspond to the minimum width on the specifications. On the other hand, the openings 601*b* corresponding to the side limiting members 83 are formed to be smaller than the openings 601*a* because they only need to correspond to the minimum width of the elongated paper sheet. FIG. 5A shows a state in which plain paper sheets having small widths of sheet sizes are stacked. FIG. 5B shows a state in which elongated paper sheets having large widths of sheet sizes are stacked.

Even the sheet feeding apparatus 30 capable of corresponding to elongated paper sheets uses plain paper sheets more frequently than the elongated paper sheets, and thus the openings 601*a* are often covered with the plain paper sheets. On the other hand, the openings 601*b* are covered only when elongated paper sheets are used and are opened when plain paper sheets are used. When using the sheet feeding apparatus 30, the user may damage the apparatus by dropping a foreign substance or the like through the openings 601*a* and 601*b*. In particular, the openings 601*b* are considered to be opened for a long time as described above, and thus a risk of dropping the foreign substance or the like through the openings 601*b* is higher than that through the openings 601*a*. Therefore, in this embodiment, the openings 601*b* are formed to have a minimum necessary size in order to prevent the drop of the foreign substance or the like therethrough.

The upper-limit sizes of the openings 601*b* may be decided so that, for example, the openings 601*b* can limit elongated paper sheets having the minimum widths to be limited when the side limiting members 83 move toward a positioning elongated hole 61*c* by a maximum moving amount. Alternatively, the openings 601*b* may be arranged to be invisible from above, as will be described below.

Figure 8:
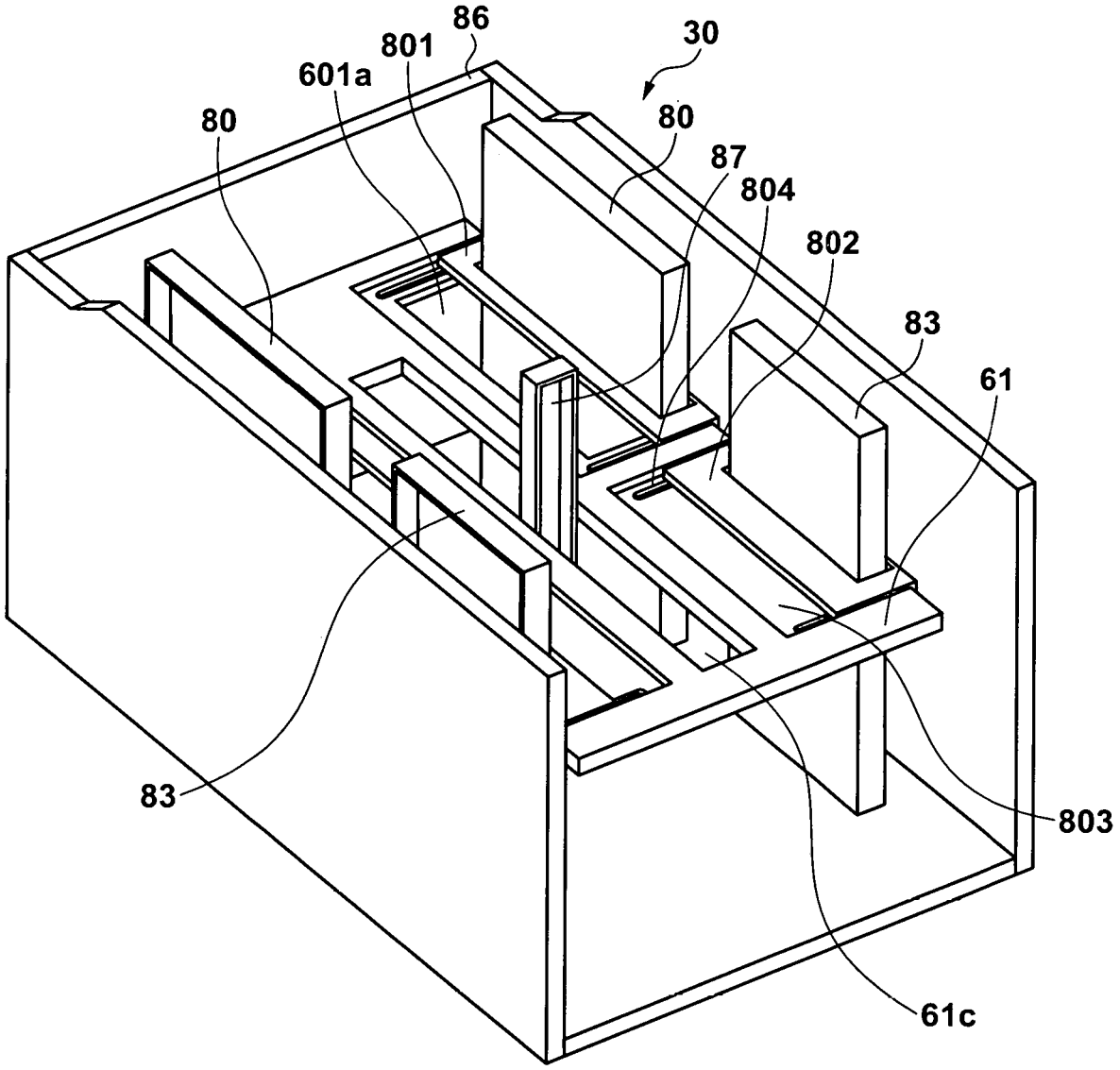
FIG. 8 is another perspective view showing the main parts of the paper deck.
Figure 9:
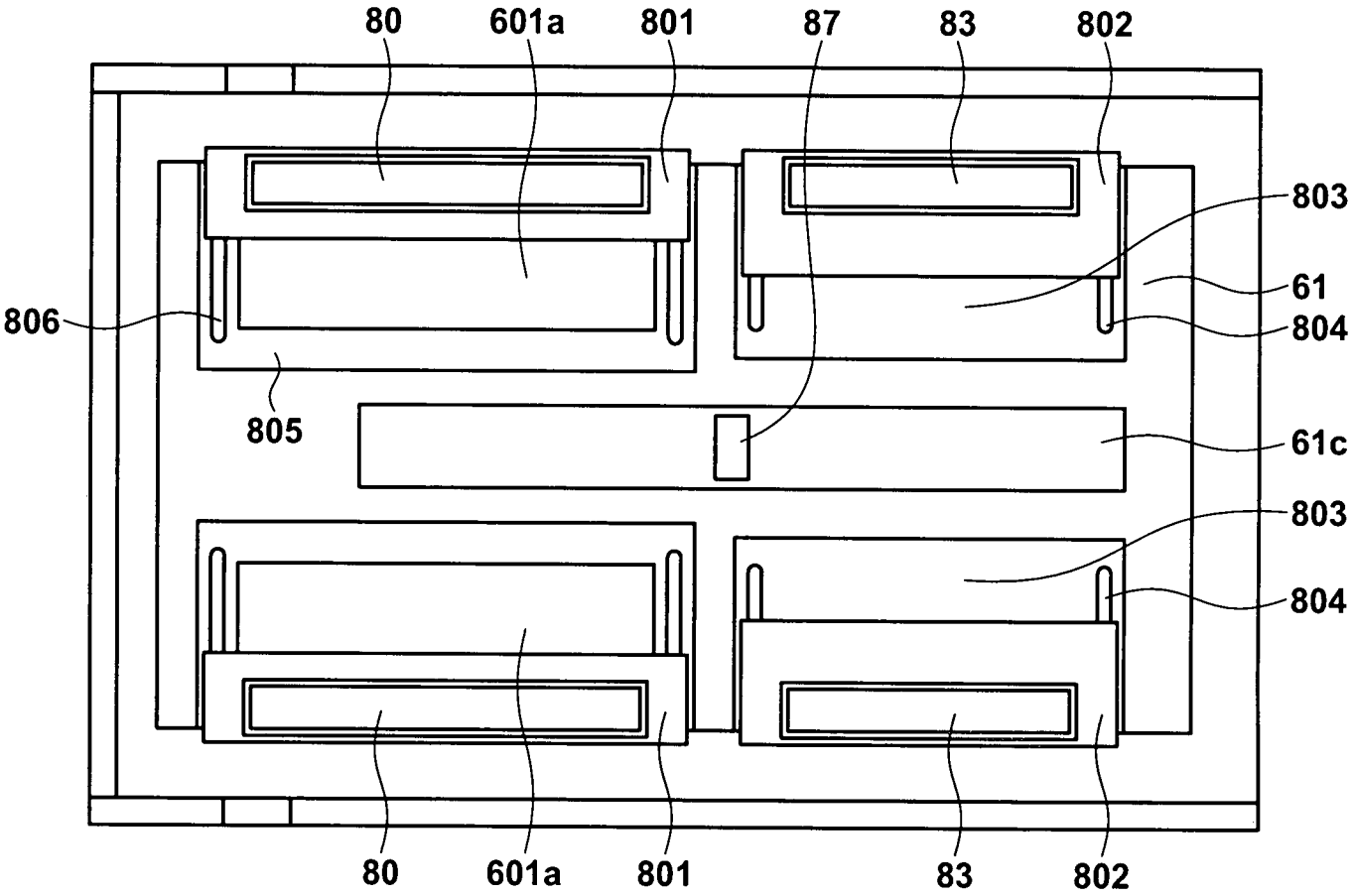
FIG. 9 is a plan view showing the main parts of the paper deck.

FIGS. 8 and 9 are views each showing an example in which the openings 601*b* are arranged to be invisible from above. FIG. 8 is a perspective view showing this, and FIG. 9 is a view when viewed from above. FIGS. 2 and 3 show an environment in which there are spaces (opening portions) between the lifter 61 and the side limiting members 83 where the foreign substance or the like easily drops. On the other hand, in FIG. 8, reinforcing members 803 are arranged between the lifter 61 and the side limiting members 83. Grooves 804 are formed in the reinforcing members 803. Support members 802 are connected to the grooves 804 and configured to be slidable almost horizontally with respect to a stacking surface in a groove direction. Therefore, when the side limiting members 83 are moved toward the positioning elongated hole 61*c*, the support members 802 are pushed from the side limiting members 83, moving toward the positioning elongated hole 61*c* along the grooves 804. The support members 802 and the reinforcing members 803 are not connected to the side limiting members 83, and thus they are movable along with the vertical moving operation of the lifter 61.

Thus, even if the side limiting members 83 are located with a maximum width, the reinforcing members 803 function as lid members that cover the openings 601*b*. This makes it possible to prevent the user from dropping the foreign substance or the like through the openings 601*b*.

As described above, in this embodiment, the reinforcing members 803 and the support members 802 are formed on the side of the extension lifter 61*b*. As shown in FIG. 9, however, support members 801 and reinforcing members 805 may be formed on the side of the main lifter 61*a*. As shown in FIG. 9, grooves 806 are formed in the reinforcing members 805, and the support members 801 are connected to the grooves 806 and configured to be slidable in a groove direction. Unlike on the side of the extension lifter 61*b*, however, the side limiting members 80 need to be movable up to the minimum width (postcard or the like) on the specifications, and thus an arrangement that covers the openings as on the side of the extension lifter 61*b* is not adopted. It is considered, however, that plain paper sheets are often placed on the side of the main lifter 61*a*, and thus the opening portions are often covered, making it possible to prevent the drop of the foreign substance or the like.

As described above, according to this embodiment, it is possible to prevent the drop of the foreign substance or the like owing to the openings 601*b* generated by limiting positions of the side limiting members 83. In addition, by arranging the reinforcing members 803 and 805 as shown in FIGS. 8 and 9, it is possible to increase the strength of the lifter 61 with respect to the weights of stacked sheets as compared with arrangements shown in FIGS. 2 and 3.

In the above-described embodiment, the arrangement using the main lifter 61*a* and the extension lifter 61*b* has been described. However, the present invention is also applicable to an arrangement in which the lifter 61 is formed by using only the main lifter 61*a*, and the side limiting members are provided on the upstream side and downstream side of the main lifter 61*a* on the feeding direction.

In the above-described embodiment, an example in which a pair of side limiting members capable of moving (capable of performing an opening operation) on both sides in the h direction of FIG. 2 are used for each of the side limiting members 80 and 83 has been described. However, only the side limiting member on one side may be made movable, or limitation may be performed by abutting sheets against a wall surface of an apparatus with one side limiting member. The present invention is also applicable to such an arrangement.

<Other Embodiments>

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-167642, filed Aug. 31, 2017, which is hereby incorporated by reference herein in its entirety.

What is claimed is:

1. A stacking apparatus capable of stacking a first sheet as a sheet fed to a predetermined apparatus and a second sheet having a larger size than the first sheet in a feeding direction in which the sheet is fed to the predetermined apparatus, the stacking apparatus comprising:

a stacking unit configured to include a stacking surface and configured to stack the first sheet and the second sheet on the stacking surface, wherein the stacking surface includes a first stacking area, a second stacking area, and a third stacking area;

a first limiting unit configured to be movable in a widthwise direction perpendicular to the feeding direction, and configured to limit edges of the first sheet and the second sheet in the widthwise direction; and a second limiting unit configured to be movable in the widthwise direction, configured to limit the edges of the second sheet in the widthwise direction, and configured to be provided on an upstream side of the first limiting unit with respect to the feeding direction, wherein a first notch portion in which the first limiting unit is movable is provided so that the first notch portion is overlapped with the first stacking area with respect to the feeding direction and provided on an outer side of the first stacking unit with respect to the widthwise direction, and a second notch portion in which the second limiting unit is movable is provided so that the second notch portion is overlapped with the second stacking area with respect to the feeding direction and provided on an outer side of the second stacking area with respect to the widthwise direction, wherein, with respect to the feeding direction, the third stacking area is provided on an upstream side of the first stacking area, and the third stacking area is provided on a downstream side of the second stacking area, and the first notch portion is provided on a downstream side of the third stacking area, and the second notch portion is provided on an upstream side of the third stacking area, and wherein, with respect to the widthwise direction, a minimum distance between the first notch portion and a center of the stacking unit is shorter than a minimum distance between the second notch portion and the center of the stacking unit, a minimum distance between the center of the stacking unit and an outer edge of the first stacking area is shorter than a minimum distance between the center of the stacking unit and an outer edge of the second stacking area, and a distance between the center of the stacking unit and an outer edge of the third stacking area is longer than the minimum distance between the second notch portion and the center of the stacking unit.

2. The apparatus according to claim 1, wherein each of the first limiting unit and the second limiting unit limits the sheet by moving a pair of limiting members in the widthwise direction, and a distance between the pair of limiting members when limiting a sheet of a minimum size in the widthwise direction to be limited by the first limiting unit is shorter than a distance between the pair of limiting members when limiting a sheet of a minimum size in the widthwise direction to be limited by the second limiting unit.

3. The apparatus according to claim 1, wherein the first notch portion and the second notch portion are arranged such that a maximum movable distance of the first limiting unit in the widthwise direction is longer than a maximum movable distance of the second limiting unit in the widthwise direction.

4. The apparatus according to claim 1, wherein the stacking unit includes a first lid member configured to be slidable in the widthwise direction and cover the first notch portion, and a second lid member configured to be slidable in the widthwise direction and cover the second notch portion.

5. The apparatus according to claim 4, wherein the first lid member is configured to slide along with movement of the first limiting unit and the second lid member is configured to slide along with movement of the second limiting unit.

6. The apparatus according to claim 4, wherein the stacking unit includes a first reinforcing member and a second reinforcing member, respectively, corresponding to the first notch portion and the second notch portion and configured to reinforce the stacking unit by filling at least parts of the first notch portion and the second notch portion, and the first lid member and the second lid member are slidably connected to the corresponding first reinforcing member and second reinforcing member.

7. The apparatus according to claim 6, wherein the first lid member is connected to a first groove provided in the first reinforcing member and the second lid member is connected to a second groove provided in the second reinforcing member.

8. The apparatus according to claim 6, wherein the first lid member and the second lid member are arranged such that upper surfaces of the first lid member and the second lid member become substantially parallel to the stacking surface.

9. The apparatus according to claim 1, wherein the stacking unit includes a first stacking unit corresponding to the first stacking area and configured to stack the first sheet and the second sheet, and a second stacking unit corresponding to the second stacking area and provided on an upstream side of the first stacking unit with respect to the feeding direction and configured to stack the second sheet, and the first notch portion is provided in the first stacking unit, and the second notch portion is provided in the second stacking unit.

10. A feeding apparatus comprising:

a stacking apparatus capable of stacking a first sheet as a sheet fed to a predetermined apparatus and a second sheet having a larger size than the first sheet in a feeding direction in which the sheet is fed to the predetermined apparatus; and a feeding unit configured to feed sheets stacked on the stacking apparatus to the predetermined apparatus, wherein the stacking apparatus includes:

a stacking unit configured to include a stacking surface and configured to stack the first sheet and the second sheet on the stacking surface, wherein the stacking surface includes a first stacking area, a second stacking area, and a third stacking area;

a first limiting unit configured to be movable along a widthwise direction perpendicular to the feeding direction, and configured to limit edges of the first sheet and the second sheet in the widthwise direction; and a second limiting unit configured to be movable in the widthwise direction, configured to limit the edges of the second sheet in the widthwise direction, and configured to be provided on an upstream side of the first limiting unit with respect to the feeding direction, wherein a first notch portion in which the first limiting unit is movable is provided so that the first notch portion is overlapped with the first stacking area with respect to the feeding direction and provided on an outer side of the first stacking unit with respect to the widthwise direction, and a second notch portion in which the second limiting unit is movable is provided so that the second notch portion is overlapped with the second stacking area with respect to the feeding direction and provided on an outer side of the second stacking area with respect to the widthwise direction, wherein, with respect to the feeding direction, the third stacking area is provided on an upstream side of the first stacking area, and the third stacking area is provided on a downstream side of the second stacking area, and the first notch portion is provided on a downstream side of the third stacking area, and the second notch portion is provided on an upstream side of the third stacking area, and wherein, with respect to the widthwise direction, a minimum distance between the first notch portion and a center of the stacking unit is shorter than a minimum distance between the second notch portion and the center of the stacking unit, a minimum distance between the center of the stacking unit and an outer edge of the first stacking area is shorter than a minimum distance between the center of the stacking unit and an outer edge of the second stacking area, and a distance between the center of the stacking unit and an outer edge of the third stacking area is longer than the minimum distance between the second notch portion and the center of the stacking unit.

* * * * *